United States Patent [19]

Matsuzaki

[11] Patent Number: 4,900,262

[45] Date of Patent: Feb. 13, 1990

[54] LOCK MECHANISM FOR ELECTRICAL CONNECTOR

[75] Inventor: Shuichi Matsuzaki, Tokyo, Japan

[73] Assignee: Hirose Electric Co., Ltd., Tokyo, Japan

[21] Appl. No.: 319,338

[22] Filed: Mar. 6, 1989

[30] Foreign Application Priority Data

Mar. 7, 1988 [JP] Japan ..... 63-29883[U]

[51] Int. Cl.[4] ..... H01R 13/648

[52] U.S. Cl. ..... 439/354

[58] Field of Search ..... 439/353, 354, 357, 358, 439/701

[56] References Cited

U.S. PATENT DOCUMENTS 3,329,925 7/1967 Johnson et al. ..... 439/357
4,602,838 7/1986 Davis et al. ..... 439/354

FOREIGN PATENT DOCUMENTS 3417855 11/1985 Fed. Rep. of Germany ..... 439/357
62-051170 3/1987 Japan .
62-131487 6/1987 Japan .

*Primary Examiner*—William Briggs
*Attorney, Agent, or Firm*—Kanesaka & Takeuchi

[57] ABSTRACT

A lock mechanism for an electrical connector having an insulating housing, contact elements arranged in the insulating housing, and a cover case for covering at least a rear portion of the insulating housing, which includes a pair of flexible lock arms extending backwardly from front ends of opposite side walls of the insulating housing; a pair of flexible control members provided on opposite side walls of the cover case; a lock member provided on each lock arm for engagement with a mating connector lock member; and an operational portion provided on the lock arm behind the lock member so that it is aligned with the control member.

3 Claims, 2 Drawing Sheets

LOCK MECHANISM FOR ELECTRICAL CONNECTOR

BACKGROUND OF THE INVENTION

The present invention relates to lock mechanisms for electrical connectors.

The conventional lock mechanisms for compact, high-density electrical connectors include mechanisms such as shown in FIG. 5 of Japanese Patent Application Kokai No. 62-51170 (hereinafter "'170 patent") and FIG. 21 of Japanese Patent Application Kokoku No. 62-131487 (hereinafter "'487 patent").

The electric connector lock mechanism as shown in FIG. 5 of the '170 patent includes a pair of cantilever lock arms extending backwardly from the front ends of opposite sides of an insulating housing. A lock projection is provided in the middle of the outside of each lock arm to engage the lock member of a mating connector. This lock is released by pressing the rear ends of the lock arms with fingers to flex them inwardly so that the electrical connector is pulled out of the mating connector.

The electrical connector lock mechanism as shown in FIG. 21 of the '487 patent has a structure substantially identical with and functions in the substantially same way as the above lock mechanisms. The rear end of a lock arm (latch) in the lock mechanism is inserted into a groove of a rear housing for protection.

The lock mechanism of the '170 patent has the following disadvantages.

(1) The lock arms of a plug housing for a compact, high-density electrical connector is so small that it is difficult to handle the grips with fingers.

(2) The grips of the lock arms are so small that it is difficult to pull the plug out of the mating connector by using the lock arms.

(3) If the lock arms are extended outwardly to mitigate the above problems, the demand for miniaturization is not met. These extended lock arms tend to break down at their joint portion because of a concentrated load. These extended lock arms tend to be entangled with each other during transportation between production stations, blocking a stream of production.

(4) The lock arms directly extending from the housing are made thin and not protected. Consequently, they are liable to deformation or damage by an external force, etc.

The lock arms of the '487 patent has disadvantages similar to the above except that the rear ends of lock arms are protected in the grooves.

SUMMARY OF THE INVENTION

Accordingly, it is an object of the present invention to provide an electrical connector lock mechanism which is free of the above problem.

According to the invention there is provided a lock mechanism for an electrical connector having an insulating housing, contact elements arranged in the insulating housing, and a cover case for covering at least a rear portion of the insulating housing, which includes a pair of flexible lock arms extending backwardly from front ends of opposite side walls of the insulating housing; a pair of flexible control members provided on opposite side walls of the cover case; a lock member provided on each lock arm for engagement with a mating connector lock member; and an operational portion provided on the lock arm behind the lock member so that it is aligned with the control member.

Other objects, features, and advantages of the present invention will be apparent from the following description when taken in conjunction with the accompanying drawings.

DESCRIPTION OF THE PREFERRED EMBODIMENT

Figure 1:
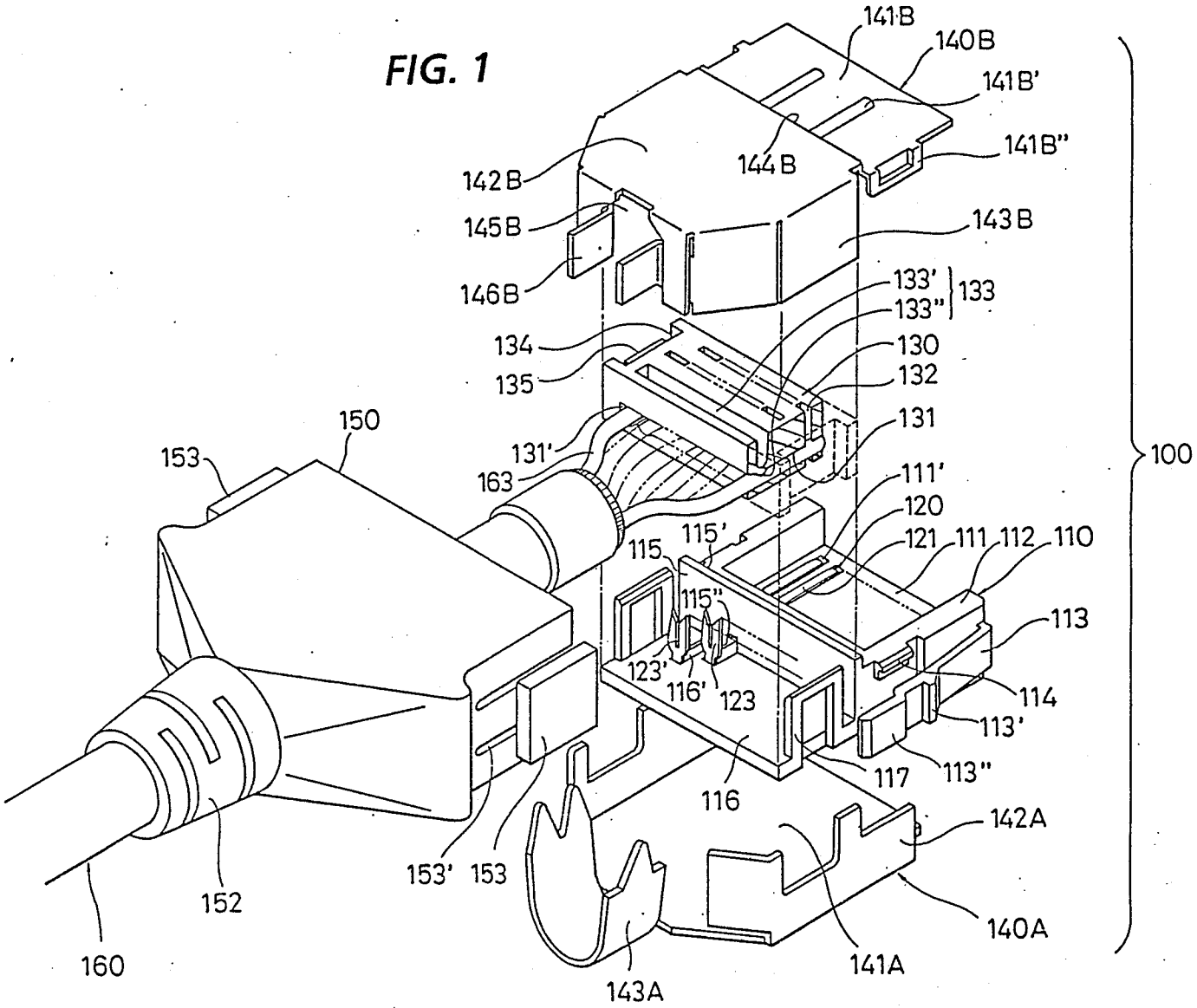
FIG. 1 is an exploded perspective view of an electrical connector plug with a lock mechanism according to an embodiment of the present invention.
Figure 2:
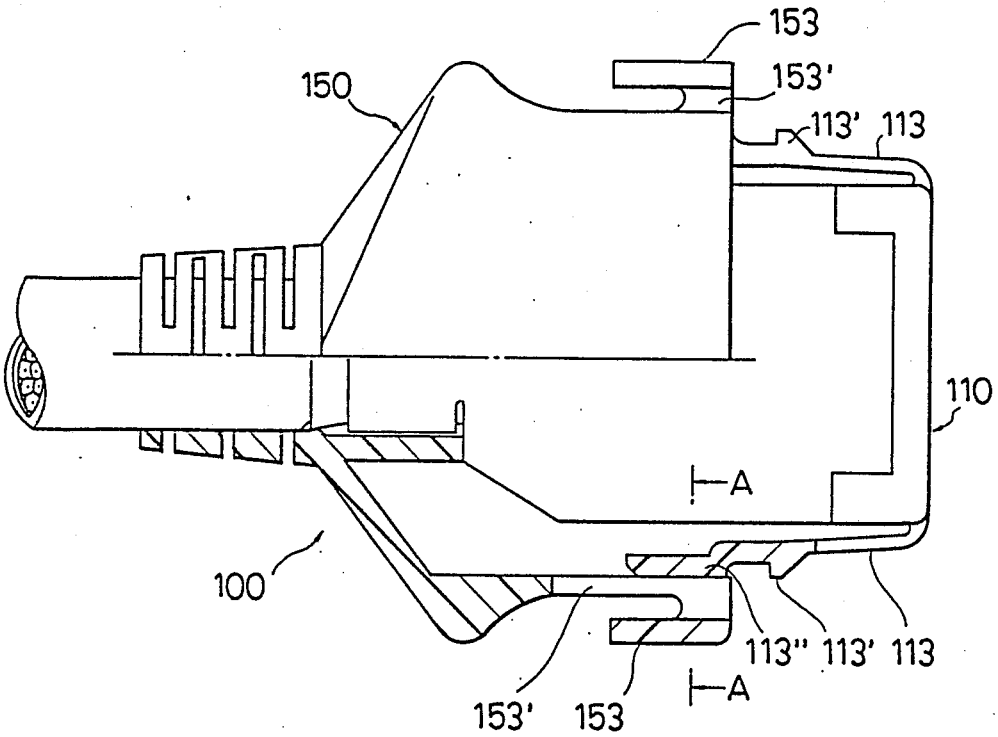
FIG. 2 is a bottom view, partially in section, of the electrical connector plug of FIG. 1.

In FIGS. 1 and 2, an electrical connector plug 100 includes an insulating housing 110, a plurality of contact elements 120, a guide plate 130, a pair of shield case sections 140A and 140B, and a cover case 150.

The insulating housing 110 is made of an insulating material, such as a plastic, so as to have a pair of side walls 112 which define a front cavity 111. A plurality of contact channels 111' are provided on the floor of the front cavity 111. A lock arm 113 extends backwardly from the front end of each side wall 112. This lock arm 113 is made flexible toward the side wall 112. A lock projection 113' is provided in the middle of the lock arm 113. A push button 113" is formed on the free end of the lock arm 113. A latch projection 114 is provided on the upper outside of each side wall 112 for engagement with the shield case.

Provided in the middle of the insulating housing 110 is a middle wall 115 which has a upper shoulder 115' and a plurality of lower apertures 115". A pair of latch arms 117 are provided on opposite sides of the rear portion of the insulating housing 110 to define a rear cavity 116 for receiving the guide plate 130. A plurality of channels 116' are provided on the floor of the rear cavity 116 for receiving the insulation piercing portions of contact elements.

The contact element 120 is made of spring sheet metal so as to have a contact portion 121 for contacting a contact element of the mating connector, an intermediate portion (not shown), and an insulation piercing portion 123 to which an insulated conductor of a cable is connected by insulation displacement.

The guide plate 130 is made of an insulating material, such as a plastic, so as to have a lateral slot 131 into which insulated conductors of a multiconductor cable are inserted for arrangement. The lateral slot 131 is tapered on the entrance side 131' to facilitate the insertion of insulated conductors. A pair of rows of vertical slots 132 are provided through the guide plate 130 in a zigzag fashion for receiving the piercing portions of contact elements. A deformable portion 133 is provided on the guide plate 130 behind the vertical slots 132 for securing insulated conductors to the guide plate 130. The deformable portion 133 consists of a deformable groove 133' and an elongated projection 133". A receiving groove 134 and an engaging projection 135 are provided on each side of the guide plate 130 for engaging the latch arm 117 to lock the guide plate 130 in the rear cavity 116.

The upper and lower shield case sections 140B and 140A are used as an EMI countermeasure. They are made of a conductive material, such as brass, and may be plated with solder. The lower shield case section 140A has a pair of side walls 142A defining a housing receiving cavity 141A, a cable grip 143A and elongated embossments. The upper shield case section 140B has a flat fitting portion 141B with elongated embossments 141B', a shoulder portion 144B, a rear enclosure 142B with a pair of side walls 143B, and a pair of deformable tabs 146B defining a cable port 145B.

The cover case 150 is made of an insulating material, such as a plastic, so as to have a unit cavity for receiving a connector unit enclosed by the shield case 140A and 140B. A cable exit 152 is provided at the rear end of the cover case 150 for allowing a cable to pass through the cover case. A pair of push buttons 153 are provided on opposite sides of the cover case 150 as control members. A pair of parallel slits 153' are provided on opposite sides of each push button 153 for making the push button flexible.

This electrical connector plug may be assembled in the following way. The insulated conductors 163 of a cable 160 to be terminated are inserted into the lateral slot 131 of the guide plate 130 and locked to the guide plate 130. The guide plate 130 is then pushed into the rear cavity 116 of the insulating housing 110 to connect by insulation displacement the insulated conductors 163 to the piercing portions 123 of contact elements 120. The shield case sections 140A and 140B are then mounted on the insulating housing 110, and the cover case 150 is then put over the shield case 140A and 140B.

Figure 3:
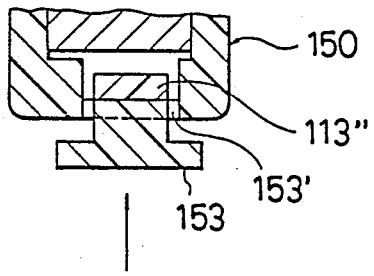
FIG. 3 is a sectional view taken along the line AA of FIG. 2.

As best shown in FIG. 2, the push button 153 of the cover case 150 is aligned with the push button 113" of the lock arm 113. This condition is shown in more detail in FIG. 3. As a result, by pressing the push button 153 in the direction of an arrow to flex the lock arm 113 inwardly, the engagement between the lock projection 113' and the mating connector may be released without difficulty.

The electrical connector lock mechanism according to the invention has the following advantages.

(1) The large control member of the cover case makes it easy to control the small lock arm of a compact, high-density electrical connector.

(2) The large control member of the cover case makes it easy to release the electrical connector out of the mating connector.

(3) Because of the large control member, it is possible to reduce the length of the lock arm thus eliminating the possibility of deformation or damage of the lock arm by an external force due to excessive lengths of the lock arm. The short lock arms also eliminate the possibility of being entangled with each other during transportation from one manufacturing station to another thus ensuring a smooth flow production.

(4) The operational portion of the lock arms is covered almost completely by the control member of the cover case for protection against external forces, etc.

While a preferred embodiment of the invention has been described above using specific terms, such description is illustrative purposes only, and it is to be understood that changes and variations may be made without departing from the spirit and scope of the invention as recited in the following claims.

What is claimed is:

1. A lock mechanism for an electrical connector including an insulating housing, contact elements arranged in said insulating housing, and an insulating cover case for covering at least a rear portion of said insulating housing, which comprises:

a pair of flexible lock arms extending backwardly from front ends of opposite side walls of said insulating housing;

a lock member provided on a middle portion of each said lock arm for engagement with a mating connector lock member;

an operational portion provided at a free end of each said lock arm, said operational portion being covered by said insulation cover case; and a pair of flexible control members provided on opposite side walls of said insulating cover case such that each said control member is positioned over said operational portion, whereby said lock members are released from said mating lock members by pressing said control members.

2. The lock mechanism of claim 2, wherein said flexible control member is defined by a pair of parallel slits provided on said side wall of said cover case to improve flexibility of said control member.

3. The lock mechanism of claim 2, wherein said control member has a substantially T-shaped cross section, with a horizontal portion having a width considerably larger than and a vertical leg portion having a width substantially equal to that of said operational portion.

* * * * *